United States Patent [19]

Regazzoni et al.

[11] Patent Number: 4,997,622

[45] Date of Patent: Mar. 5, 1991

[54] HIGH MECHANICAL STRENGTH MAGNESIUM ALLOYS AND PROCESS FOR OBTAINING THESE ALLOYS BY RAPID SOLIDIFICATION

[75] Inventors: Gilles Regazzoni; Gilles Nussbaum, both of Grenoble, France; Haavard T. Gjestland, Porsgrunn, Norway

[73] Assignees: Pechiney Electrometallurgie, Courbevoie, France; Norsk Hydro A.S., Oslo, Norway

[21] Appl. No.: 427,133

[22] PCT Filed: Feb. 23, 1989

[86] PCT No.: PCT/FR89/00071

§ 371 Date: Oct. 25, 1989

§ 102(e) Date: Oct. 25, 1989

[87] PCT Pub. No.: WO89/08154

PCT Pub. Date: Sep. 8, 1989

[30] Foreign Application Priority Data

Feb. 26, 1988 [FR] France ..... 88 02885
Feb. 1, 1989 [FR] France ..... 89 01913

[51] Int. Cl.[5] ..... C22C 23/02; C22C 23/04

[52] U.S. Cl. ..... 420/407; 148/11.5 P; 148/403; 148/420; 419/12; 419/29; 419/33; 420/406

[58] Field of Search ..... 420/407, 406; 148/11.5 P, 403, 420; 419/23, 29, 33

[56] References Cited

U.S. PATENT DOCUMENTS

| | | | |
|---|---|---|---|
| 2,264,310 | 12/1941 | Hanawalt et al. | 75/168 |
| 3,094,413 | 6/1963 | Fisher et al. | 148/420 |
| 3,496,035 | 2/1970 | Foerster | 148/420 |
| 4,675,157 | 6/1987 | Das et al. | 420/405 |
| 4,718,475 | 1/1988 | Das et al. | 164/415 |
| 4,765,954 | 8/1988 | Das et al. | 420/403 |

FOREIGN PATENT DOCUMENTS

| | | | |
|---|---|---|---|
| 888973 | 12/1943 | France . | |
| 0027994 | 12/1964 | Japan | 420/407 |
| 579654 | 8/1946 | United Kingdom . | |

*Primary Examiner*—Upendra Roy

*Attorney, Agent, or Firm*—Dennison, Meserole, Pollack & Scheiner

[57] ABSTRACT

Magnesium alloy having a breaking load of at least 290 MPa, more particularly at least 330 MPa, having the following composition by weight: Al 2–11%, Zn 0–12%, Mn 0–0.6%, Ca 0–7%, but with the presence of at least Zn and/or Ca, having a mean particle size less than 3 μm, a homogeneous matrix reinforced with intermetallic compounds having a size less than 1 μm precipitated at the grain boundaries, this structure remaining unchanged after storage at 200° C. for 24 hours; and a process for producing it by rapid solidification and consolidation by extrusion at a temperature between 200° and 350° C.

13 Claims, No Drawings

HIGH MECHANICAL STRENGTH MAGNESIUM ALLOYS AND PROCESS FOR OBTAINING THESE ALLOYS BY RAPID SOLIDIFICATION

1. FIELD OF THE INVENTION

The present invention relates to magnesium-based alloys with high mechanical strength, and to a process for obtaining them by rapid solidification and consolidation by extrusion. In particular it relates to alloys which contain aluminum and at least zinc and/or calcium, and may contain manganese, with a composition by weight within the following limits:

Al: 2–11%
Zn: 0–12%
Mn: 0–0.6%
Ca: 0–7% but always with the presence of zinc and/or calcium, having the following content of impurities:

Si: 0.1–0.6
Cu: <0.2
Fe: <0.1
Ni: <0.01, the rest being magnesium.

In particular, it relates to said high mechanical strength alloys having a composition corresponding to that of basic commercial alloys in the prior art, listed in the ASTM standards by the designations AZ31, AZ61, AZ80 (wrought alloys) and AZ91, AZ92 (casting alloys), or G-A3Z1, G-A6Z1, G-A8Z, G-A9Z1 and G-A9Z2 in French standard NF A 02-004; it also relates to alloys having a composition corresponding to these basic commercial alloys to which calcium is added. It should be noted that these alloys contain manganese as an element of addition.

2. STATE OF THE ART

Producing magnesium alloys with high mechanical properties by rapid solidification has already been proposed.

In European Patent Disclosure Document EP 166917, a process of obtaining alloys based on high mechanical strength magnesium has been described, comprising producing a thin ribbon (<100 μm) of alloy by pouring over the rim of a chilled rotating drum, grinding the ribbon thus obtained, and compacting the powder.

The magnesium-based alloys used include from 0–11 atom % aluminum, 0–4 atom % of zinc and 0.5–4 atom % of an element of addition such as silicon, germanium, cobalt, tin or antimony. Aluminum or zinc may also be replaced, at a proportion of up to 4%, with neodymium, praseodymium, yttrium, cerium, or manganese.

The alloys thus obtained have a breaking load on the order of 414 to 482 MPa, an elongation that can attain 5%, and good resistance to corrosion by 3% aqueous NaCl solutions.

In European Patent Disclosure Document EP 219628, high mechanical strength magnesium alloys have also been described that are obtained by rapid solidification, which as alloy elements include from 0–15 atom % aluminum and from 0–4 atom % zinc (having a total of the two of between 2 and 15%), and a complementary addition of 0.2–3 atom % of at least one element selected from the group including Mn, Ce, Nd, Pr, Y, Ag.

However, this process requires the use of non-standard magnesium alloys, including certain elements of addition that are high in cost and often difficult to put into solution and that require that the ribbons obtained in the rapid solidification be ground prior to the compacting.

3. SUBJECT OF THE INVENTION

A first subject of the present invention relates to magnesium-based alloys, consolidated after rapid solidification, having elevated mechanical properties, having a breaking load at least equal to 290 MPa, but more particularly at least 330 MPa and an elongation at break at least equal to 5%, and having the following characteristics in combination:

a composition by weight within the following limits:

| | |
|---|---|
| aluminum | 2–11% |
| zinc | 0–12%, preferably 0.2–12% |
| manganese | 0–0.6%, preferably 0.1–0.2% |
| calcium | 0–7% |

but always with the presence of zinc and/or calcium having the following content of principal impurities:

| | |
|---|---|
| silicon | 0.1–0.6% |
| copper | <0.2% |
| iron | <0.1% |
| nickel | <0.01% |

the rest being magnesium;

a mean particle size less than 3 μm;

they comprise a homogeneous matrix reinforced with particles of intermetallic compounds precipitated at the grain boundaries, these compounds being $Mg_{17}Al_{12}$, optionally $Mg_{32}(Al, Zn)_{49}$, the latter being present when the alloy contains zinc, with contents higher than approximately 2%, and optionally $Al_2Ca$ when the alloy contains Ca, with a mean size of less than 1 μm and preferably less than 0.5 μm, this structure remaining unchanged after being kept for 24 hours at 200° C.

The alloy must contain at least one of the elements Zn or Ca, or a mixture of the two; when Zn is present, its content is preferably is at least 0.2%.

When Mn is present, it is an at least quaternary element, and its minimum content by weight is preferably 0.1%.

In the case where there is no Ca, the alloy has the following preferred composition by weight:

| | |
|---|---|
| aluminum: | 2–11% |
| zinc: | 0.2–12% |
| manganese: | 0.1–0.6% |

with the content of principal impurities always being the same, and the rest being magnesium.

In particular, it may have the compositions corresponding to those of the commercial alloys indexed in the ASTM standard by the commercial designations AZ31, AZ61, AZ80 (wrought alloys) and AZ91, AZ92 (casting alloys), or G-A3Z1, G-A6Z1, G-A8Z, G-A9Z1 and G-A9Z2, respectively, by the French standard NF A-02-004; in other words, Al 2–11%, Zn 0.2–3%, Mn 0.1–0.6% (impurity content unchanged).

In the case of the addition of calcium, the quantities by weight added are between 0.5 and 7%. This addition then makes it possible to improve the characteristics of the magnesium-based alloys, in particular those containing Al and/or Zn and/or Mn, obtained after rapid quench hardening and consolidation by extrusion, even at an extrusion temperature between 250 and 350° C.

Thus the alloys that are of particular interest are those containing calcium having the following compositions by weight:

| | |
|---|---|
| aluminum: | 2-11% |
| zinc: | 0-12% |
| Mn: | 0-0.6% |
| calcium: | 0.5-7% |

with the content of principal impurities always being the same and the rest being magnesium.

In the final alloy, the dispersoids already noted are present, and calcium may also be in the form of dispersoids of $Al_2Ca$ precipitated at the grain boundaries and/or in solid solution. The particles of the intermetallic compound $Al_2Ca$ appear when the concentration of Ca is sufficient; they have a size less than 1 μm and preferably less than 0.5 μm. The presence of Mn is not necessary, if Ca is already present.

In all these alloys, the sum of the contents of Al, Zn and/or Ca typically does not exceed 20%.

A second subject of the present invention is a process for obtaining these alloys characterized in that said alloy, in the liquid state, is subjected to rapid chilling, at a rate at least at least equal to $10^4$ $K^{s-1}$, so as to obtain a solidified product at least one of the dimensions of which is less than 150 μm, that the solidified product is then compacted by extrusion by a temperature between 200° and 350° C.

4. DESCRIPTION OF THE INVENTION

One characteristic of the invention is that it applies to conventional magnesium alloys, normally intended for the foundry (casting) or for welding (wrought alloys), without any supplementary addition whatever of an alloy element or elements intended to modify its structure as is the case in the prior art.

As starting material, alloys of the types G-A3Z1, G-A6Z1, G-A8Z, G-A9Z1 and G-A9Z2, (by French standard NF A 02704) are preferably used, of which the ranges in chemical composition have been given above; in particular, they contain additions of Mn.

According to the invention, however, Ca may also be added to improve their mechanical properties obtained upon consolidation, which is performed at a higher temperature.

The process includes the following steps:

a. Production of the alloy from its ingredients (by the conventional processes), or preferably the use of ingots of alloys from typical commercial purveyors. b. Pouring of the alloy by rapid solidification (overhardening), furnishing a solidified product at least one of the dimensions of which is less than 150 μm. These processes essentially include pouring of a thin ribbon on a rotating chilled drum, pulverization of the liquid alloy on a renewed, highly chilled surface, and atomization of the liquid alloy in a jet of inert gas.

These processes make it possible to obtain chilling speeds faster than $10^{4°}$ C./sec. c. Compacting of the solidified product rapidly, for example in the form of a bar or profile section or billet with a view to performing a forging operation or some later shaping operation.

The various conditions for performing the successive steps are as follows:

1. First Embodiment

The process begins with the alloy in the liquid state, and it is poured in the form of a thin ribbon, less than 150 μm and preferably on the order of 30 to 50 μm in thickness, and with a width of several millimeters, for example 3-5 mm, but these figures do not constitute any limitation of the invention. This pouring is performed using an apparatus known as "rapid solidification" or "roll overhardening", combining the processes known in the English-language literature as "free jet melt extrusion" or "planar flow casting" or "double roller quenching". With various variants, this apparatus essentially includes a molten alloy reservoir, a nozzle for distributing the molten alloy onto the surface of a rotating drum that is energetically cooled, and a means for protecting the molten alloy from oxidation using inert gas.

In one embodiment of the invention, work was done on a pouring drum chilled with water, and provided with a rim of cupro-beryllium. The molten alloy is ejected from the crucible by the application of argon at overpressure.

The pouring parameters are as follows:

speed of rotation of the wheel: It is on the order of 10 to 40 meters per second at the level of the chilled surface;

temperature: The alloy must be completely liquid and fluid. Its temperature must be greater than approximately 50° C. (standard value) at the liquidus temperature of the alloy. The chilling speed under these conditions is between $10^5$ and $10^6$ $K^{s-1}$. Under the conditions described above, long ribbons 30 to 50 μm in thickness and 1 to 3 mm in width are obtained.

The purpose of the second step is to consolidate the overhardened ribbons. To preserve the fine original structure obtained by rapid solidification, it is absolutely necessary to avoid long exposure to the elevated temperatures required by such manufacturing processes as sintering. Hence the choice has been made to use lukewarm extrusion. With consolidation by extrusion, the length of time of the passage at elevated temperature can be minimized; moreover, the shearing caused by the extrusion destroys the thin oxide film that is inevitably present on the overhardened products and thus assures better cohesion of the sample.

The extrusion conditions were as follows:

temperature between 200° and 350° C., which corresponds to the temperature range for extrusion of conventional magnesium alloys. In the course of our experiments, the extrusion press container and the press were brought to the test temperature prior to the extrusion;

extrusion ratios between 10 and 40, which are sufficiently high to assure good cohesion of the ribbons to the inside of the extruded bars, while avoiding excessive dynamic heating of the extruded product. The most favorable ratios, however, are between 10 and 20;

forward speed of the press ram: from 0.5 to 3 mm per second; in certain cases, for example in the presence of calcium, it may be higher (for example, 5 mm/sec). It is selected to be relatively low, so as once again to avoid excessive heating of the sample.

In this first embodiment of the invention the magnesium ribbons may be either introduced directly into the press container and extruded, or precompacted while cold or lukewarm (at a temperature lower than 250° C., for example), with the aid of a press in the form of a billet, the density of which is approximately 99% of the theoretical density of the alloy, this billet then being extruded and then introduced, by cold precompacting up to 70% of the theoretical density, into a sheath of magnesium, magnesium alloy, aluminum, or aluminum alloy, which in turn is introduced into the extrusion press container; after extrusion, the sheath can then be fine-walled (less than 1 mm) or thick-walled (up to 4 mm). In all cases, it is preferable for the alloy comprising the sheath to have a flow limit that does not exceed the order of magnitude of that of the product to be extruded, at the extrusion temperature.

2. Second Embodiment of the Invention

In this variant, a rotary electrode is melted by a beam of electrons or an electric arc (atomization by rotating electrode), or a liquid jet is mechanically divided in contact with a body of rotation, and the fine droplets are projected onto a highly chilled, clean or reconditioned surface, but in any case kept unencumbered that is, without there being any adhesion of solidifed metal particles on this surface; the droplets may also be projected into a flow of inert gas, at low temperature (centrifuge atomization). As has been indicated already, the parameters of the operation must be selected such that at least one of the dimensions of the metal particles is less than 150 μm. These processes are known per se and are not part of the invention.

The order of the process is in accordance with that of the first embodiment, for all the steps in consolidation of the metal particles.

3. Third, Variant Embodiment

In this variant, the alloy particles are obtained by liquid alloy atomization in a jet of inert gas. This operation is once again well known per se and is not part of the invention. It makes it possible to furnish particles of dimensions smaller than 100 μm. These particles are generally of spherical shape, while those obtained by the second variant above are still in the form of small plates of slight thickness.

The compacting of these particles is again effected along the same lines as in the first and second embodiments.

Nevertheless, as a variant, other compacting methods may be used that do not require raising the temperature of the product beyond 250° or 250° C. in the presence of calcium; among these optional methods can be cited hydrostatic extrusion, forging, rolling and superplastic forming, which are well known processes to one skilled in the art; they need not be described here in further detail.

In the various embodiments, the products obtained may be degassed prior to extrusion, at a temperature that does not exceed 350° C. In that case the procedure may be as follows: The ribbons are precompacted cold in a can, and the entirety may be placed in an oven in a vacuum. The can is sealed in a vacuum and then extruded. However, the degassing may be done dynamically instead: The divided products are degassed and then compacted in a vacuum in the form of a billet with closed pores, which is then extruded.

PROPERTIES OF THE PRODUCTS OBTAINED

The mechanical properties of the extruded products obtained according to the invention were measured and compared with those of products obtained in the conventional manner by extrusion of a billet obtained by pouring the same alloy in an ingot mold, as well as with those of samples taken directly from the crude billet from the foundry. The following results were obtained:

In Table I, the operational conditions of the extrusion are shown, along with the properties of the alloys obtained according to the invention:

Hv = Vickers hardness
TYS = elastic limit measured at 0.2% tensile elongation
UTS = breaking load
e% = elongation at break
CYS = elastic limit measured at 0.2% compression deformation

TABLE I

| Test No. | Alloy Type Composition by weight %[1] | Extrusion Temp. in °C. | Extrusion Ratio | Ram Speed in mm/s | Hv in Kg/mm2 | TYS (0.2) MPa | UTS MPa | e % |
|---|---|---|---|---|---|---|---|---|
| 1 | AZ 31 (Al 3%, Zn 1%) | 200 | 20 | 0.5 | 105 | 424 | 445 | 11.5 |
| 2 | AZ 66 (Al 6.5%, Zn 6%) | 200 | 20 | 0.5 | 125 | 403 | 459 | 16 |
| 3 | ZA 119 (Al 9%, Zn 11%) | 200 | 20 | 0.5 | 145 | 482 | 548 | 5.2 |
| 4 | AZ 91 (Al 9%, Zn 1%) | 200 | 20 | 0.5 | 129 | 457 | 517 | 11.1 |
| 5 | AZ 91 (Al 9%, Zn 1%) | 200 | 12 | 0.5 | 120 | 424 | 468 | 5.6 |
| 6 | Al 1%, Ca 1% | 300 | 20 | 0.5 | 84 | 408 | 411 | 8.7 |
| 7 | Al 9%, Ca 1% | 200 | 20 | 0.5 | 139 | 500 | 555 | 6.9 |
| 8 | Al 3%, Ca 6.5% | 250 | 20 | 0.5 | 116 | 551 | 570 | 5.6 |
| 9 | Al 5%, Ca 3.7% | 250 | 20 | 0.5 | 124 | 538 | 567 | 5.2 |
| 10 | Al 5%, Ca 3.5%, Mn 0.1% | 300 | 20 | 0.5 | 103 | 469 | 488 | 8.6 |
| 11 | Al 5%, Ca 3.5%, Mn 0.5% | 300 | 20 | 0.5 | 100 | 483 | 492 | 8.0 |
| 12 | AZ 91 + Ca 2% (Al 9%, Zn 0.6%, MnO 2%, Ca 2%) | 250 | 20 | 0.5 | 125 | 427 | 452 | 5.4 |
| 13 | AZ 91 | 200 | 20 | 0.5 | 80 | 160 | 320 | 10 |

TABLE I-continued

| Test No. | Alloy Type Composition by weight %[1] | Extrusion Temp. in °C. | Extrusion Ratio | Ram Speed in mm/s | Hv in Kg/mm2 | TYS (0.2) MPa | UTS MPa | e % |
|---|---|---|---|---|---|---|---|---|
| | TG treated[2] | | | | | | | |

[1]Test alloys 1, 4, 5 and 13 have compositions identical to those of commercial alloys and contain 0.15% manganese. The remainder of all the compositions comprises magnesium.
[2]After consolidation by extrusion according to the invention, this alloy was subjected to a thermal treatment T6 (24 hours at 400° C. followed by 16 hours at 200° C.).

Table II gives the properties of alloys of equivalent composition obtained in the conventional manner:

TABLE II

| Test No. | Alloy Type[1] | Process for for obtaining it | Hv Kg/mm2 | TYS (0.2) MPa | UTS MPa | e % |
|---|---|---|---|---|---|---|
| 14 | AZ 31 | as extruded | | 170 | 250 | 5 |
| 15 | AZ 91 | as cast | 61 | 60 | 125 | 4 |
| 16 | AZ 91 | as cast + T6 | 72 | 120 | 140 | 1.1 |
| 17 | AZ 91 | as extruded | 82 | 226 | 313 | 15.6 |
| 18 | AZ 91 | as extruded + T6 | 79 | 167 | 329 | 11.1 |

[1]It will be recalled that AZ31 includes 2.5 to 3.5% Al and 0.5 to 1.5% Zn, and AZ91 includes 8.3 to 10.3% Al and 0.2 to 1% Zn as principal elements, and 0.15% manganese.

These properties of the alloys according to the invention are quite exceptional for the type of alloy used; among other features that can be noted are the increase in the elastic limit, for the alloy AZ91, which (in Tests 17–4) rises from 226 to 457 MPa (+102%), and the breaking load, which rises from 313 to 517 MPa (+65%), with an elongation of 11.1%, which is again highly satisfactory.

It can also be noted that the T6 treatment, which is favorable for the conventional products, in the prior art (Tests 17–18), degrades the properties of the products of the invention (Tests 4–13).

This table also shows that according to the invention, alloys with increased mechanical properties are obtained from alloys with high zinc content (Tests 2–3).

In general, the hardness, elastic limit and breaking load depend very strongly on the extrusion conditions.

Table III below assembles a certain number of mechanical properties of products of alloys AZ91 solidifed rapidly and then compacted by extrusion, according to the invention. The parameters can be varied: extrusion ratio (from 12 to 30), temperature and speed of extrusion (200'0 to 350° C. and 0.5 to 3 mm per second, respectively).

TABLE III

| Mechanical Properties of AZ91 Treated in Accordance with the Invention | | | | | | | |
|---|---|---|---|---|---|---|---|
| Extrusion Temp. in °C. | Extrusion Ratio | Extrusion Speed in mm/sec | Hardness Hv, in Kg/mm² | Elastic limit TYS | Elastic limit CYS | Breaking load UTS, MPa | Alloy e % |
| 350 | 12 | 0.5 | 93 | 297 | 302 | 344 | |
| 350 | 20 | 0.5 | 95 | 304 | 310 | 351 | |
| 250 | 12 | 0.5 | 113 | 364 | 360 | 441 | 14.1 |
| 250 | 20 | 0.5 | 120 | 391 | 380 | 457 | 12.1 |
| 200 | 20 | 0.5 | 125 | 440 | 452 | 504 | 8.7 |
| 200 | 20 | 3 | 108 | 348 | 355 | 422 | 18.6 |
| 250 | 30 | 0.5 | 122 | 382 | | 466 | 10.9 |
| 250 | 30 | 3 | 105 | 303 | | 400 | 20.1 |
| 250 | 20 | 3 | 105 | 318 | 305 | 404 | 19.6 |

It can be seen that the mechanical properties decrease when the extrusion temperature increases, and that the hardness increases when the extrusion ratio increases until arriving at a plateau more or less rapidly depending on the temperature. In the temperature range of 200° to 250° C., it is preferable to use an extrusion ratio of 20. For smaller ratios, the cohesion among the ribbons or among the projected or atomized metal particles may be insufficient.

The breaking load (UTS), the elastic limit (TYS, 0.2), and the hardness decrease (while the elongation increases) when the extrusion speed changes from 0.5 to 3 mm/s.

It can be seen that the best association of mechanical properties is obtained for an extrusion temperature of 200° C., and an extrusion ratio of 20 (this refers to the ratio of the surface area of the blank to that of the extruded product) and a forward speed of the ram of the press of 0.5 mm/sec.

However, this disadvantage can be overcome by adding calcium, which enables a very pronounced improvement in the thermal stability of the mechanical properties, at least up to 350° C. Tests 6–12 demonstrate this beneficial influence; especially in Tests 10–12, the mechanical properties remain quite high despite an extrusion temperature toward the high end of the range (Test 11).

In Tests 11 and 12, the presence of $Al_2Ca$ particles is noted.

It is also important to stress that the elastic limit CYS for compression is at least equal to (and sometimes greater than) the tensile elastic limit, which is quite exceptional since the same alloys, in conventional manufacturing, have a compression limit on the order of 0.7 times the tensile limit. This signifies that in the design of parts subjected to compressive strain, the alloys according to the invention bring a major improvement, on the order of 30%.

CHARACTERIZATION OF THE PRODUCTS OBTAINED ACCORDING TO THE INVENTION

The remarkable mechanical properties of the alloys according to the invention are essentially due to the fact that the process used produces to a very fine grain structure, in the micrometer range (0.7 to 1.5 on average). The structure cannot be resolved under an optical microscope; it is only by electron microscopy that it can be verified that the products according to the invention do in fact comprise a homogeneous matrix reinforced with particles of intermetallic compounds of a size less than 0.5 μm, precipitated at the grain boundaries, these being $Mg_{17}Al_{12}$, and also $AL_2Ca$, under certain conditions mentioned above. The presence in the grains of precipitates less than 0.2 μm in size of a compound based on Al Mn Zn is also noted. The general structure is equiaxially granular. The precipitates do not have the same morphology as the precipitates of structural hardening observed in the samples of the same alloys obtained by conventional metallurgy.

This structure further has remarkable thermal stability, because it remains unchanged after 24 hours of storage at 200° C. for the alloys not containing calcium and up to 350° C. for those containing it. No softening or hardening is manifested at all, which is not the case for the conventional magnesium alloys with structural hardening.

TESTS OF CORROSION RESISTANCE

The resistance to corrosion is evaluated by measuring weight loss in an aqueous 5% (by weight) solution of NaCl, the result of which is expressed in "mcd" (milligrams per square centimeter per day).

The tests performed on a group of products according to the invention yield results between 0.4 and 0.6, while the same alloys, manufactured by conventional metallurgy, yield results between 0.6 and 2 mcd. It can thus be confirmed that the corrosion resistance of the alloys according to the invention is at least equal to that of the conventional alloys, and is in fact at the same level as the strength of high-purity alloys such as AZ91E produced by Dow Chemical Corporation. It is confirmed that the alloys according to the invention generally exhibit corrosion that is without pitting and is more uniform than that of these AZ91E alloys.

The presence of calcium further improves the corrosion resistance; corrosion becomes very slow and extremely uniform. For example, the weight loss is 0.075 $mg/cm^2$ per day for the alloy of Test 12, while it is 0.4 $mg/cm^2$ per day for AZ91 without calcium in Test 4.

ADVANTAGES OBTAINED BY THE INVENTION

The implementation of the invention has numerous advantages in the use of conventional magnesium alloys obtained by rapid solidification and compacting. Among them can be cited the following, in particular:

reinforcement of the mechanical properties compared with conventional manufacturing, with a spectacular improvement. An elastic limit of 457 MPa associated with an elongation of 11.1% for an alloy derived from a commercial alloy having a density of 1.8 opens up numerous possible uses in the aerospace industries and even for land vehicles. The best magnesium alloy at present, which is ZK60 (magnesium-zinc-zirconium), has an elastic limit at ambient temperature of 290 MPa, and its production is complicated by the fact that zirconium is difficult to put into solution.

Furthermore, the resistance to softening by prolonged baking at 200° C. constitutes a notable improvement compared with the conventional alloys with structural hardening.

The equality of the compressive and tensile elastic limits (while the ratio between these properties is on the order of 0.7 in conventional manufacturing) makes it possible to improve and/or lighten the weight of parts made of magnesium alloys subjected to compressive strains.

An improvement is noted in the embodiment by plastic deformation—a weakness of magnesium alloys, because of their hexagonal structure—because of the fineness of the grains in the products according to the invention.

The invention is used for conventional alloys, which are listed in the catalogs of all manufacturers and are standardized in the majority of countries. There is no added production cost.

The corrosion resistance is on the level of that of high-purity magnesium alloys that must be produced by special processes and hence entail major added cost.

Extrusion may be done with any of the conventional presses; canning of the products to be compacted is not required.

The addition of calcium makes it possible to improve the mechanical properties, assure stability of the structure up to 350° C., and improve the corrosion resistance simultaneously.

We claim:

1. A magnesium-based alloy having a breaking load at least equal to 290 MPa and an elongation at break at least equal to 5%, said alloy consisting essentially of, by weight;

| | |
|---|---|
| aluminum | 2–11%; |
| manganese | 0.1–0.6%; |
| calcium | 0–7%; |
| zinc | 0.2–12%; |
| the principal impurities | |
| silicon | 0.1–0.6%; |
| copper | 0–0.2%; |
| iron | 0–0.1%; |
| nickel | 0–0.01%; |
| and the remainder magnesium; | |

said alloy having a mean particle size of less than 3 μm, and comprising a homogeneous matrix reinforced with particles of the intermetallic compound $Mg_{17}Al_{12}$, and optionally, at least one of the compounds $Mg_{32}(Al, Zn)_{49}$ and $Al_2Ca$, of a mean size less than 1 μm precipitated at the grain boundaries, the alloy structure remaining unchanged after storage for 24 hours at 200° C.

2. A magnesium-based alloy having a breaking load at least equal to 290 MPa and an elongation at break at least equal to 5%, said alloy consisting essentially of, by weight:

| | |
|---|---|
| aluminum | 2–11%; |
| manganese | 0–0.6%; |
| calcium | 0.5–7%; |
| zinc | 0–12%; |
| the principal impurities | |
| silicon | 0.1–0.6%; |
| copper | 0–0.2%; |
| iron | 0–0.1%; |
| nickel | 0–0.01%; |
| and the remainder magnesium; | |

said alloy having a mean particle size of less than 3 μm, and comprising a homogeneous matrix reinforced with particles of the intermetallic compound $Mg_{17}Al_{12}$, and optionally, at least one of the compounds $Mg_{32}(Al,Zn)_{49}$ and $Al_2Ca$, of a mean size less than 1 μm precipitated at the grain boundaries, the alloy structure remaining unchanged after storage for 24 hours at 200° C.

3. The alloy as defined by claim 1 , containing substantially no calcium.

4. A process for producing an alloy as defined by claim 1 or 2, comprising the steps of subjecting said alloy, in the liquid state, to rapid chilling at a rate at least equal to $10^4 \cdot K \cdot s^{-1}$ to obtain a solidified product at least one of the dimensions of which is less than 150 μm, and then compacting said solidified product directly by extrusion at a temperature between 200° and 350° C.

5. The process as defined by claim 4 wherein the rapid chilling is carried out by pouring the alloy in the liquid state onto a chilled movable surface as a continuous ribbon of alloy having a thickness of less than 150 μm.

6. The process as defined by claim 4 wherein the rapid chilling is carried out by finely dividing the liquid into fine droplets of alloy and depositing the droplets on a chilled surface kept unencumbered.

7. The process as defined by claim 4, wherein the rapid chilling is carried out by atomization of the liquid alloy by means of a jet of inert gas.

8. The process as defined by claim 4 wherein the rapidly solidified product is compacted by press extrusion at a temperature between 200° and 350° C., with an extrusion ratio between 10 and 40, and at a forward speed of the ram of the press between 0.5 and 3 mm/sec.

9. The process as defined by claim 4 wherein the rapidly chilled product is introduced directly into an extrusion press container.

10. The process as defined by claim 4 wherein the solidified product is extruded in a metal sheath made of aluminum, magnesium, or an alloy based on one of these two metals.

11. The process as defined by claim 4 wherein the solidified product is precompacted in the form of a billet at a temperature equal at most to 200° C., before extrusion.

12. The process as defined by claim 4 wherein the solidified product is degassed in a vacuum at temperature lower than or equal to 350° C. prior to extrusion.

13. The process as defined by claim 8, wherein the extrusion ratio is between 10 and 20.

* * * * *